US007542581B2

(12) United States Patent
Baumann

(10) Patent No.: US 7,542,581 B2
(45) Date of Patent: Jun. 2, 2009

(54) EAR INSERT FOR A HEARING AID

(75) Inventor: Joachim Baumann, Markt Schwaben (DE)

(73) Assignee: Siemens Audiologische Technik GmbH, Erlangen (DE)

( * ) Notice: Subject to any disclaimer, the term of this patent is extended or adjusted under 35 U.S.C. 154(b) by 736 days.

(21) Appl. No.: 11/070,451

(22) Filed: Mar. 2, 2005

(65) Prior Publication Data

US 2005/0196004 A1 Sep. 8, 2005

(30) Foreign Application Priority Data

Mar. 5, 2004 (DE) ..... 10 2004 010 864

(51) Int. Cl.
*H04R 25/00* (2006.01)

(52) U.S. Cl. ..... 381/328; 381/322; 381/380

(58) Field of Classification Search ..... 381/322, 381/324, 328, 330, 380, 309, 382, 71.6, 317, 381/318; 181/129, 130, 135
See application file for complete search history.

(56) References Cited

U.S. PATENT DOCUMENTS 5,195,139 A * 3/1993 Gauthier ..... 381/322
5,832,094 A * 11/1998 Le Her ..... 381/328
7,079,662 B2 * 7/2006 Niederdränk ..... 381/328

FOREIGN PATENT DOCUMENTS

DE 199 43 809 A1 3/2001

* cited by examiner

*Primary Examiner*—Huyen D Le

(57) ABSTRACT

Feedbacks in hearing aids are to be attenuated and avoided in a cost-effective and efficient manner. The invention thus proposes producing a hearing aid component at least partially from a material comprising a plurality of Helmholtz resonators (8). An otoplastic (2) can be produced from a material of this type for example, thus enabling high frequency sound which leaks out of a ventilation bore (5) in the otoplastic (2) and which leads to feedback, to be attenuated in the otoplastic (2).

2 Claims, 1 Drawing Sheet

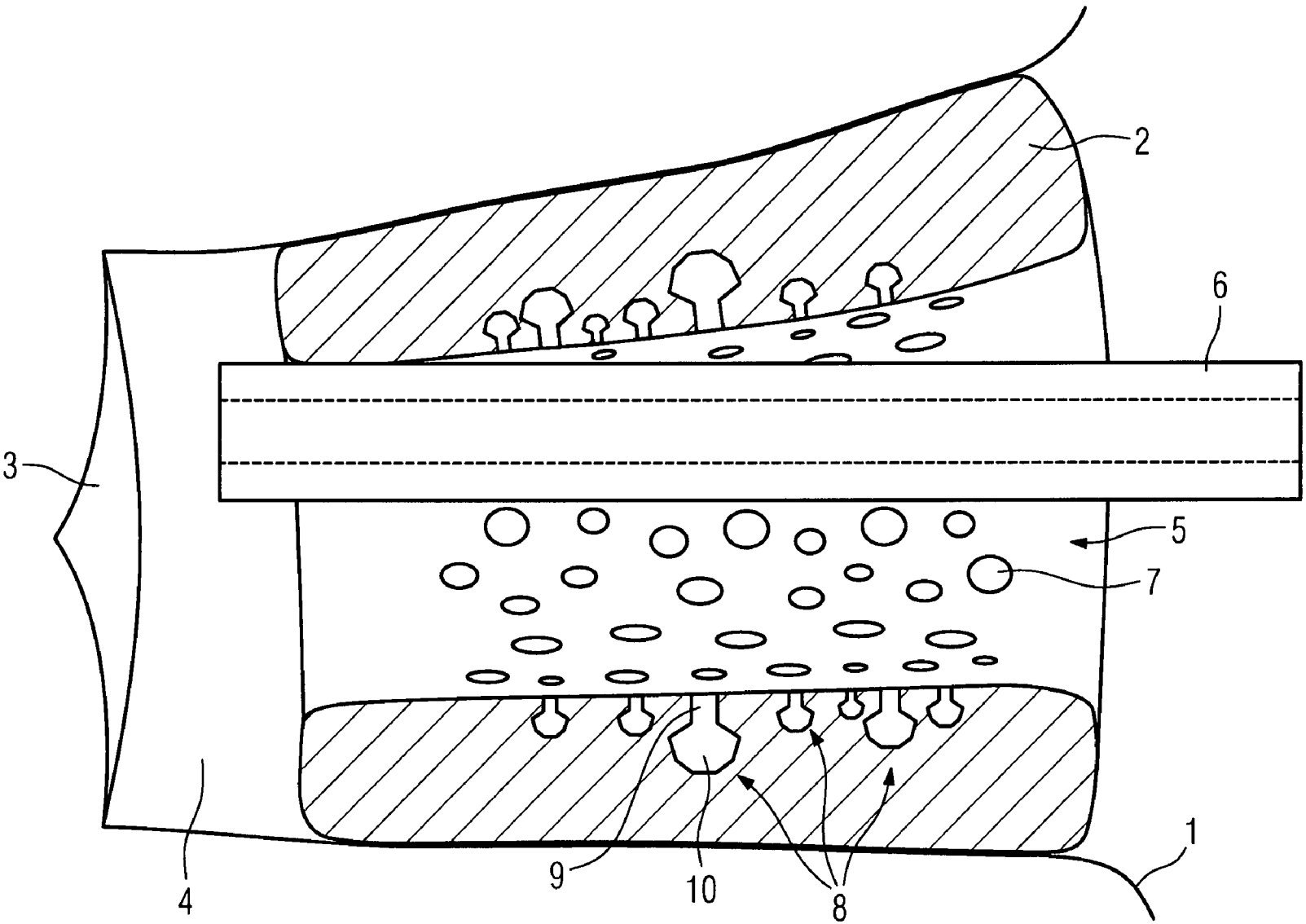
1
2
3
4
5
6
7
8
9
10

EAR INSERT FOR A HEARING AID

CROSS REFERENCE TO RELATED APPLICATIONS

This application claims priority to the German application No. 10 2004 010 864.1, filed Mar. 5, 2004 which is incorporated by reference herein in its entirety.

FIELD OF INVENTION

The present invention relates to an earpiece and a sound tube for hearing aids.

BACKGROUND OF INVENTION

The application of otoplastics for attaching hearing aids to the auditory canal generally requires a ventilation bore to avoid inflammations of the auditory canal skin resulting from the moisture buildup for example, and to avoid injuries to the eardrum due to excess or negative pressure for example. The ventilation bore can have a relatively large diameter, particularly for certain high-tone hearing losses, thereby ensuring that as much low tone sound as possible reaches the ear drum in a natural manner. The more open the auditory canal is, the better the otoplastic is accepted. A so-called tube holder is used in borderline cases, which only minimally reduces the lumen (opening) of the auditory canal. Open otoplastics of this type are nevertheless disadvantageous in that the amplified sound can come back out of the ear, thus leading to unpleasant feedback. The actual amplification of the hearing aid which can be used is thereby restricted.

Specific circuits for the frequency-specific restriction of amplification at the feedback frequency have thus been used in hearing aids in order to avoid these types of feedback. Alternatively or in addition, an active feedback compensator is integrated into the hearing aid, said feedback compensator eliminating the feedback frequencies in the frequency response. 10 db amplification reserves can be achieved in this manner.

Furthermore, an IdO hearing aid with a vent and/or ventilation bore is known from the publication WO 92/21218. A Helmoholtz resonator is attached to the vent in order to attenuate the frequency. The attenuated frequency is determined, among other things, by the length of the vent and the volume in the housing.

A hearing aid with a stepped body is disclosed in the publication DE 199 43 809 A1, said stepped body protruding into the user's outer auditory canal. The stepped body reduces the free volume between the otoplastic and the ear drum and also enables additional acoustic measures for influencing the frequency response. One or more resonators, Helmholtz resonators for example, can be arranged in the stepped body, said resonators being attached to the sound channel of the stepped body and effecting an amplified attenuation of selected frequency ranges.

SUMMARY OF INVENTION

An object of the present invention is to provide an improved ear insert which better avoids feedback with open supply of the hearing-impaired person.

This object is achieved by the claims.

Since annoying feedback is generated at high frequencies, the present invention can be used to reduce the high-frequency sound ratio coming from the ear, without negatively influencing the desired acoustic supply of mid and low frequency sounds. The feedback tendency thereby reduced results in an increase in the actual amplification of a hearing aid which can be used, even without active feedback suppression. Nevertheless this active feedback suppression can also be used in combination with the present invention. In this case, with the aid of the invention, hearing losses can be more easily openly attended to, which were hitherto only be supplied using small ventilation bores.

The sound tube according to the invention which is provided with the Helmholtz resonators preferably protrudes into the auditory canal when the hearing aid is worn. This enables the attenuation of certain frequencies in the auditory canal.

It is beneficial for the Helmholtz resonators to be designed for a frequency range above 1000 Hz, in order to attenuate the sound. This allows particularly high tones to be sufficiently attenuated, said tones normally resulting in annoying feedback.

The individual Helmholtz resonators in the material can be of different sizes, thus enabling the sound to be attenuated in wider frequency bands.

Basically each component in a hearing aid can be manufactured from a type of material with a plurality of Helmholtz resonators. Nevertheless it is particularly advantageous if said components located on the feedback path of the sound, in particular the ventilation bore in an earpiece, are manufactured from this material, or coated with this material.

A sound tube which is fed into the material of the otoplastic or through the ventilation bore of an earpiece, can also be manufactured from sound-absorbing material, or coated therewith, said sound tube thus also helping to avoid feedback.

The earpiece mentioned can be designed as an otoplastic or an Ido or its housing. The invention is thus particularly useful for hearing aid wearers.

BRIEF DESCRIPTION OF THE DRAWINGS

The present invention is described in more detail with reference to the attached drawing, which shows a cross -section through an otoplastic according to the invention.

The exemplary embodiment described in more detail below represents a preferred embodiment of the present invention.

DETAILED DESCRIPTION OF INVENTION

An essentially hollow cylindrical otoplastic 2 is inserted into an auditory canal 1. The ear drum 3 is located at the end of the auditory canal 1. A specific residual volume 4 remains between the ends of the otoplastic 2 and the ear drum. The hole of the hollow cylindrical otoplastic 2, namely the ventilation bore, is identified by the number 5. A sound tube 6 is guided through this ventilation bore 5, which channels the sound from the hearing aid (not shown) to the ear drum 3. For high tone loss, the vent and/or the ventilation bore 5 typically have a diameter of at least 2 mm. Low tones can thus reach the ear drum 3 directly through the vent 5. High tones are also guided outwards through the vent 5, said high tones being fed through the sound tube 6, channeled outwards, thus resulting in an interference feedback via the microphone of the hearing aid.

The total sound from the sound amplified by the hearing aid and the low frequency sound ratio flowing through the opening of the otoplastic 2 combine in the residual volume 4 in the front of the ear drum 3.

Openings 7 of Helmholtz resonators 8 are arranged on the inner wall of the otoplastic 2. Each of these Helmholtz resonators 8 has a neck 9 and an attenuation volume 10. The frequency which is attenuated by the Helmholtz resonator 8 is essentially characterized by the volume, the neck length and the opening radius of this Helmholtz resonator. Various Helmholtz resonators of different sizes are thus arranged on the inner wall of the otoplastic 2, in order to attenuate sound over a wide frequency range. The higher the number of resonators, the higher the attenuation. Steriolithography can be used for example for production of this type of otoplastic with a plurality of Helmholtz resonators 8.

The acoustic resonators 8 are preferably distributed over the entire inner wall. It can however be favorable to keep a contamination area in the ventilation bore 5 free from these resonators 8, said contamination area arranged in proximity to the ear drum 3.

In this particular case, the acoustic resonators are designed such that they enable an effective acoustic attenuation of the sound energy for a frequency range extending from above 1000 Hz to 20 kHZ. Since the sound absorption is frequency-dependent, frequencies below the threshold frequency are virtually unattenuated.

This design according to the invention allows the maximum useable critical amplification to be increased, this resulting above all in annoying feedbacks with an open supply, in particular also with HdO devices. In many cases, this dispenses with expensive feedback compensators. A further cost saving can thus be achieved in that the different sizes of Helmholtz resonators absorb a wide frequency range and thus there is no need to match their resonance frequency specifically to the feedback frequency.

The invention claimed is:

1. An otoplastic earpiece for use in conjunction with a hearing aid, comprising:

a ventilation bore sized and arranged to ventilate an ear of a patient wearing the earpiece, with a plurality of Helmholtz-resonators positioned along an inner surface of the ventilation bore and configured to reduce feedback of high frequency sound above 1,000 Hz travelling toward the hearing aid without adversely impacting the desired acoustic supply of lower frequency sound provided from the hearing aid; and a sound tube positionable within the ventilation bore for guiding an acoustic sound signal.

2. The earpiece according to claim 1, wherein the earpiece comprises a plurality of Helmholtz-resonators having different sizes.

* * * * *